United States Patent [19]

Worth

[11] 4,428,637

[45] Jan. 31, 1984

[54] CONNECTOR STRUCTURE FOR FLAT CABLE

[75] Inventor: Sidney V. Worth, Flourtown, Pa.

[73] Assignee: Continental-Wirt Electronics Corp., Warminster, Pa.

[21] Appl. No.: 951,629

[22] Filed: Oct. 16, 1978

[51] Int. Cl.[3] ..... H01R 13/36

[52] U.S. Cl. ..... 339/99 R

[58] Field of Search ..... 339/97 R, 97 P, 98, 339/99 R, 103

[56] References Cited

U.S. PATENT DOCUMENTS

| | | | |
|---|---|---|---|
| 3,990,767 | 11/1976 | Marozny | 339/97 P |
| 4,006,957 | 2/1977 | Marozny | 339/99 R |
| 4,084,878 | 4/1978 | Wahi | 339/99 R |
| 4,145,103 | 3/1979 | Knowles | 339/99 R |

FOREIGN PATENT DOCUMENTS

| | | | |
|---|---|---|---|
| 2604027 | 9/1976 | Fed. Rep. of Germany | 339/99 R |
| 2351514 | 12/1977 | France | 339/99 R |

*Primary Examiner*—Joseph H. McGlynn

*Attorney, Agent, or Firm*—Ostrolenk, Faber, Gerb & Soffen

[57] ABSTRACT

A connector structure for making electrical connection to a plurality of individual conductors contained within a flat wire cable has a plurality of fixed length flexible contact members assembled in parallel relationship in an insulation base. Each of the contact members has a nose portion at one end extending through the base and a piercing tail at the other end extending above the base and contained in a slot formed in a side extending from the base. A flexible connection region connects the piercing tail to the nose. The flexible connection region of each contact is pre-bent to accommodate a variable lateral spacing between the piercing and nose portions of each contact element. Alternatively, the contacts may be designed to bend in the same direction during installation. A rib is provided adjacent each contact member to align it with the corresponding slot. The central region of each contact is engaged by a contact locking plug which is frictionally held in the base. A plain cover is latched on the base and can press the individual conductors of a single flat cable into piercing contact with each of the contacts in the base.

18 Claims, 25 Drawing Figures

250
252
258
260
257
202
203
251
255
190
193
256
223
200
191
195
201
215
140
192
101
105
220
104
102
100
194
221
152
172
153
37
34
32
81
80
38c
38b
173
150
38a
103
47
46
176
151
30
170
38
36
33
175
171
35
31

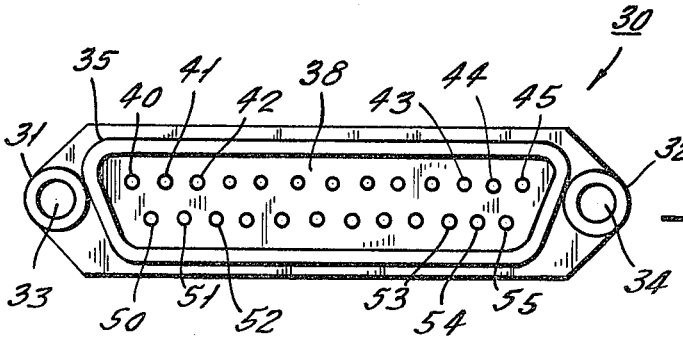
FIG. 3.
FIG. 2.
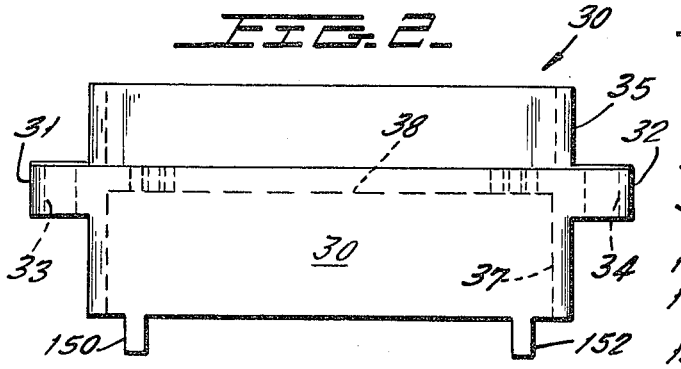
FIG. 5.
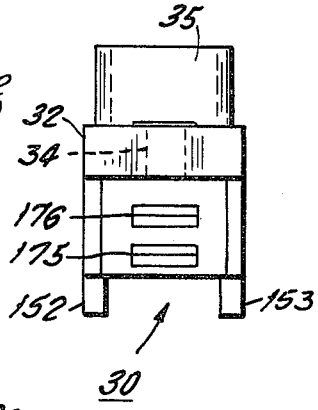
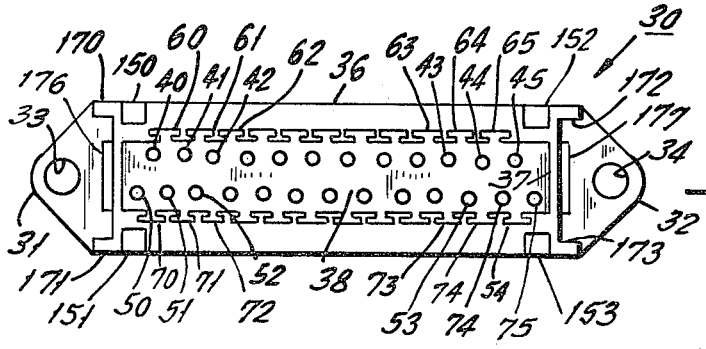
FIG. 4.
FIG. 6.
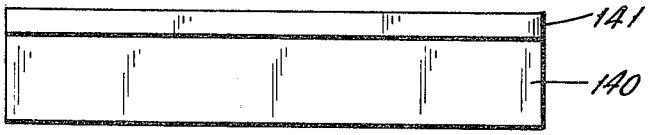
FIG. 7.
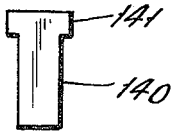

FIG. 21.
FIG. 18a.
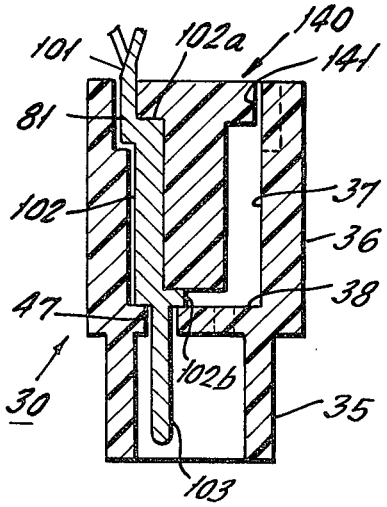
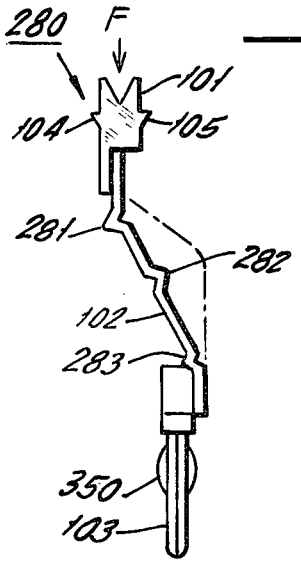
FIG. 22.
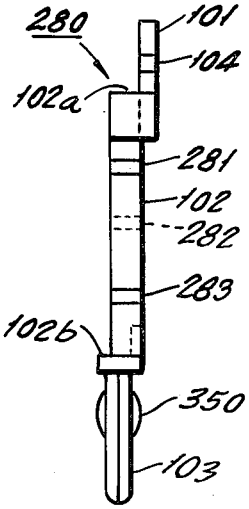
FIG. 23.
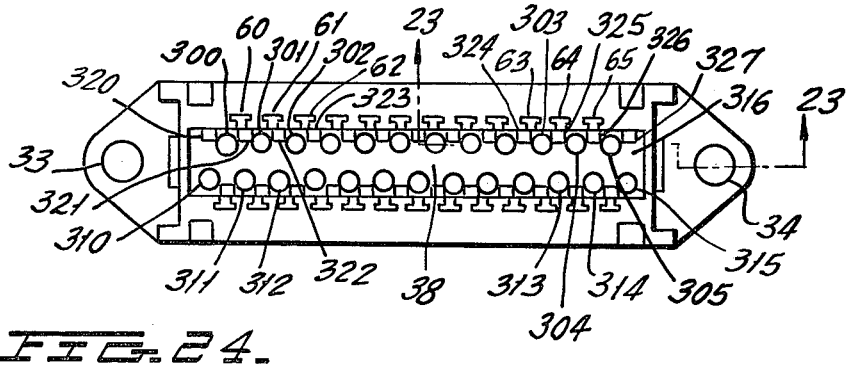
FIG. 24.
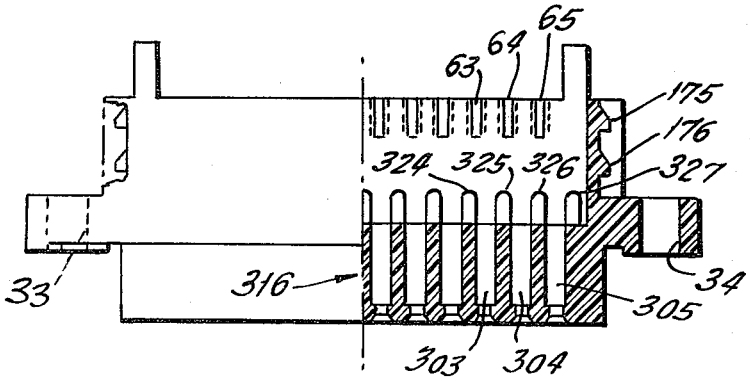

CONNECTOR STRUCTURE FOR FLAT CABLE

RELATED APPLICATION

This application is related to copending application Ser. No. 951,746, filed Oct. 16, 1979, entitled CONNECTOR STRUCTURE FOR FLAT CABLE, in the name of William F. O'Shea, Jr. and assigned to the assignee of the present invention.

BACKGROUND OF THE INVENTION

This invention relates to a connector structure for making connection to the individual conductors of a flat cable and more specifically relates to a novel connector structure having a generally D-shaped surface configuration.

D-type cable connectors are well known in the art and are shown, for example, in U.S. Pat. No. 3,930,708. Cable connectors of this type generally having piercing contacts for making piercing contact engagement with the individual conductors of a flat cable. These individual conductors are conventionally round in cross-section, but may also be rectangular or flat. These piercing contacts, hereafter referred to as the contact tail, are connected to pin-type regions, hereafter referred to as nose regions of the contact. The nose regions of each contact extend into a D-shaped shroud and can be plugged into a cooperating plug connector so that convenient connection can be made to the individual conductors of the flat cable. Connectors of this general type are sometimes called insulation displacement connectors (IDC).

In connectors of this type, the contact nose pins at the D face are commonly on 0.054 inch centers. The individual conductors of the flat cable, however, are commonly spaced on 0.050 inch centers. Thus, the problem exists of making electrical connection from the noses on one center spacing to the cable conductors on a different center spacing.

Numerous structures have been suggested in the past to solve this problem. For example, in one available connector the cable is split longitudinally before it is positioned within the connector so that the cable is formed into flat bundles of three or more bundles, each of which is spaced to be disposed over respective piercing contact tails which are on larger centers. However, since the cable conductors can be separated in bundles of three or more, it is possible to accommodate the bundles on 0.050 inch centers to the tails on 0.054 inch centers.

In another known arrangement, the flat cable is manufactured with short sections which are preformed on 0.054 inch centers interposed in longer sections on conventional 0.050 centers. These short centers then mate directly onto the contact tails which are on 0.054 inch centers.

Another solution which has been used in the past is to use a contact structure having a piercing end and a nose end which are connected by two spaced bars. These two spaced bars are then laterally deflected as necessary to accommodate the lateral displacement between a particular conductor and a particular contact nose location for that cable on the base of the connector. With this type of arrangement, since each of the contact assemblies has a fixed length, the contact tails will have different heights within the connector, since those which have a smaller lateral offset from their nose end will have a higher position within the connector.

Other problems exist with prior art D-type connectors since the connector can make connection to the cable in only one of an open face connection or a closed face connection. By open face is meant an arrangement wherein the cable is laid on top of physically accessible piercing contact tails and is then pressed by hand or with a tool onto the contact tails. The cable and contacts can then be visually inspected. In the closed face assembly, a cable is simply inserted between the piercing contact tails and a cover, which is loosely held onto the base and hides the cable and the contact tails. The cover is then pressed onto the connector and forces the cable conductors into respective piercing contact tails. The cover then latches onto the base and thus the pierced cable cannot be inspected. It is frequently desirable to use either an open or closed face arrangement for making contact between the cable conductors and the piercing contact tails.

The prior art has also provided arrangements for both plain covers and strain relief covers for ribbon cable connectors. A device of this type is shown, for example, in U.S. Pat. No. 3,355,699 dated Nov. 28, 1967. In devices of the type known, however, once the covers are connected, it is difficult if not impossible to disconnect them from the base.

BRIEF DESCRIPTION OF THE PRESENT INVENTION

In accordance with the present invention a novel construction is provided for a D-type connection in which the individual contact elements each consist of identical members having a contact piercing tail end, a pin or nose end which serves as the conductor pin and a flexible interconnecting region which will bend in a given direction during assembly of the contacts in their base. These contacts may be pre-bent before assembly, or may be formed to bend in the preferred direction when a longitudinal stress is applied to the contact. Each of the contact elements are then assembled into the base with their nose end passing through an opening in the base region and with their contact tail end being received and held in a suitable slot in a wall of the base. The flexible interconnecting regions which tend to bend in the same given direction then bend either more or less, in the same direction, to accommodate the lateral spacing between the contact tail end and nose end since this spacing will be different for each contact depending on its position along the length of the base.

The contacts are assembled in such a manner that the flexible regions of each contact flex in the same direction to prevent the possibility of contact between the contacts of adjacent elements.

Further in accordance with the invention, a novel plain cover arrangement is provided wherein a plain cover can be latched in a final position and in an open position on the base of the device. Thus, the same cover can be used whether the assembly is made with an open or closed face assembly procedure. In the closed face assembly procedure, the cable is laid into the base and is automatically located by locating base posts and the cover is then pressed from a loosely held upper latching position to a second and closed latch position. The cover can be loosely held in its first latch position and can be easily removed from the first latching position if an open face assembly is desired.

The plain cover itself carries latching cams at end regions which can latch a second strain relief cover which can be applied over the plain cover. Both the strain relief cover and plain cover are additionally guided and located relative to the base by upstanding guide wall sections which extend from the base. Both the plain cover and strain relief cover have cutout regions which align with the cable guiding posts on the base of the device.

BRIEF DESCRIPTION OF THE DRAWINGS

FIG. 2 is an elevation view of the base of the connector of the present invention.

FIG. 3 is a top view of FIG. 2.

FIG. 4 is a bottom view of FIG. 2.

FIG. 5 is an end view of FIG. 2.

FIG. 6 is an elevation view of the plug structure which is used to hold the contact elements firmly in the base after their assembly.

FIG. 7 is an end view of the plug of FIG. 6.

FIG. 18*a* is a cross-sectional view of FIG. 18 to illustrate the manner in which the plug secures the contacts within the base.

FIG. 21 is an elevational view of a modified contact constructed in accordance with the present invention.

FIG. 22 is a side view of FIG. 21.

FIG. 23 is a view similar to that of FIG. 4 but shows the base for a female plug which will cooperate with the male plug of the preceding figures, and further shows the use of contact guiding protrusions or ribs for each of the nose-receiving openings in the base.

FIG. 24 is a partial cross-section of FIG. 23 taken across section line 24—24 in FIG. 23.

DETAILED DESCRIPTION OF THE INVENTION

Referring first to FIGS. 1 to 5, there is illustrated in each of these Figures the connector base 30 where the base is formed of any desired plastic insulation material and is formed by any desired molding process. Base 30 has extending connection regions 31 and 32 which have mounting openings 33 and 34, respectively, to enable suitable mounting of the assembly. A D-shaped insulation shroud 35 is integral with the base 30 and shrouds the contact noses which are contained within the integral shroud structure. The D-shaped configuration, as well as protecting the contact noses contained therein, also acts to polarize the contact noses relative to a cooperating D-shaped plug which is conventionally used for D-shaped connectors of the type to which this invention relates.

Figure 1:
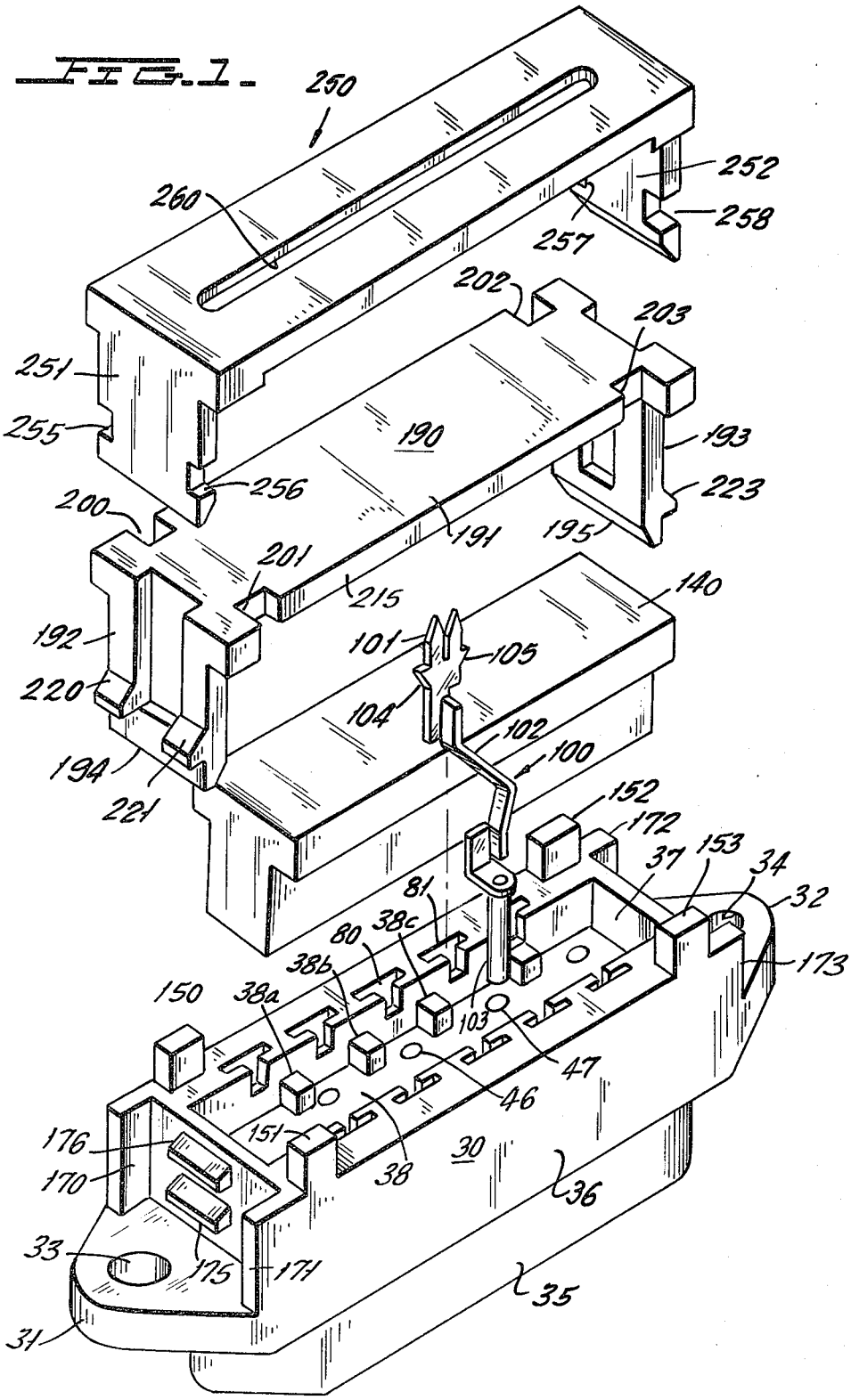
FIG. 1 is an exploded perspective view of the novel connector of the invention showing only a single contact in place and with dimensions exaggerated for purposes of clarity.
Figure 9:
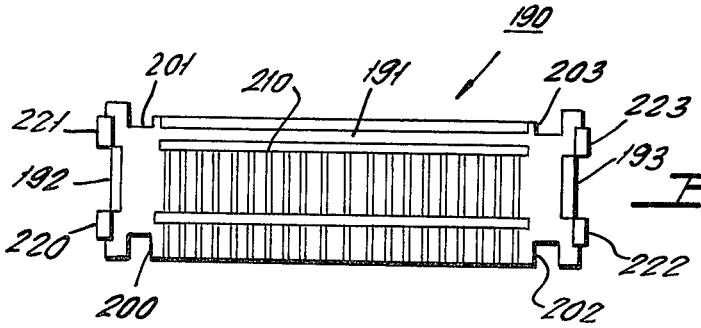
FIG. 9 is a top view of FIG. 8.

The main body portion 36 of the base 30 has an elongated rectangular well 37 therein which has a base web 38 which has two rows of staggered openings for receiving the contact noses. These include openings 40 to 45 identified in FIGS. 3, 4 and 18. Only a few of the openings including openings 46 and 47 are shown in FIG. 1 for purposes of clarity. In an actual unit, any desired number of contact noses would be used and by way of example a total number of 25 noses is conventional with 13 noses in one row and 12 in the other row. The contact noses can be either male pin-type elements or female pin receptor elements for receiving the male pins of a male connector. If desired, the nose could also be a solid bar or the like.

In FIGS. 3 and 4, each nose in the lower row of noses passes through openings 50 to 55 which are staggered relative to the other row of noses 40 to 45. The lateral spacing between each of the pins of each row is 0.108 inch (two times 0.054 inch). Thus, the adjacent conductors in a flat cable of conductors will be engaged by noses of alternate rows of openings 40 to 45 and 50 to 55, respectively.

The base structure 30 next has T-shaped slots extending along its side walls, including T-shaped slots 60 to 65 which are disposed adjacent openings 40 to 45, respectively, and slots 70 to 75 which are disposed adjacent openings 50 to 55, respectively, as best shown in FIG. 4. FIG. 1 shows T-shaped slots 80 and 81 disposed adjacent openings 46 and 47.

Each of the nose openings in the base web 38 will cooperate with a respective T-shaped slot in the wall of elongated opening 37 and is in general registry with the pin opening. The T-shaped slots, however, are on centers of 0.100 inches so that they will be laterally displaced from their respective nose opening by a different distance for each adjacent nose and slot pair. By way of example the center-most T-shaped slot and central nose pair may be directly in lateral alignment, but nose locations further from the lateral center of the device will have an increasing lateral separation from their respective slot locations. This can be seen in FIG. 18 where the T-shaped slots 60 and 61 are laterally displaced from their respective openings 40 and 41 by a rather large distance, whereas the centrally located T-shaped slots 90 and 91 are in lateral alignment with their respective pin openings 92 and 93. Similarly the nose openings 44 and 45 are laterally displaced from their respective T-shaped slots 62 and 63, but the lateral displacement is in a direction opposite to that of the displacement of members 60 and 61 relative to members 40 and 41, respectively.

The openings in the base 38 and the corresponding T-shaped slots in the base 38 described above are for the purpose of positioning a plurality of contact assemblies within the base. Each of the plurality of conductors has the configuration shown in FIGS. 1, 15, 16, 17 and 18 for a first embodiment of the invention employing a pre-bent contact element. The contact assembly 100 is a conductive stamping of spring-type conductive material and has a piercing or tail end 101 which can be of the type shown in U.S. Pat. No. 3,858,159 in the name of Sidney Worth, dated Dec. 31, 1974 and assigned to the assignee of the present invention.

Figure 15:
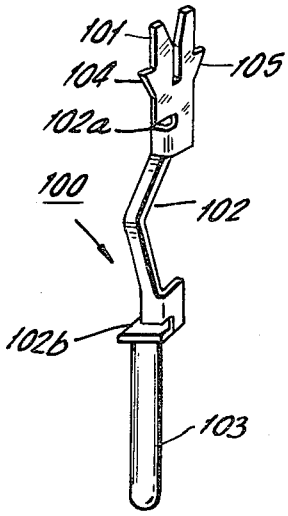
FIG. 15 is a perspective view of one contact element which can be used in accordance with the present invention.
Figure 16:
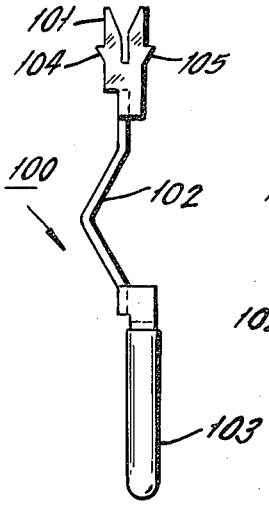
FIG. 16 is an elevation view of the contact of FIG. 15.
Figure 17:
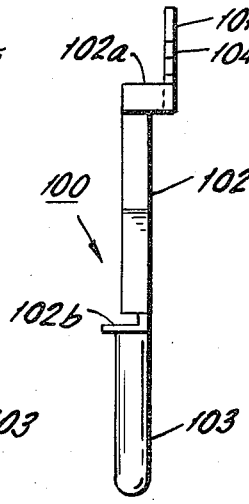
FIG. 17 is a side view of FIG. 16.

The contact tail 101 is connected to a generally flexible connection strap region 102 which is pre-bent at its center as shown best in FIGS. 15, 16 and 17 so that, as will be later seen in connection with FIG. 18, all of the contact elements can be assembled to bend in the same direction. The pre-bent strap region 102 is then fixed to a contact nose region 103. The connection between the contact tail end 101 and strap 102 is such that the base of the tail portion extends along the length of the T-shaped slot which is to receive the contact. To assemble the contact in the base 30, the assembler inserts the nose portion 30 of FIG. 1 through opening 47 in the base web 38 and presses the entire contact downwardly until the contact piercing tail region 101 seats into the T-shaped slot 81. The nose 103 will then extend below the web 38 and into the open region covered by shroud 35. The contact tail 101 will have a vertical position fixed by the depth of the T-shaped slot 81. Preferably, the contact tail 101 has barbs 104 and 105 which are forced into the side walls of slots 81 to lock the contact elements in place after insertion into slots 81. Rounded upsets can be used in place of the barbs.

Since the slot 81 is laterally offset from the center of opening 47, if the connection region 102 were rigid, each contact would require a length tailored to its particular location in the row of openings. Alternatively, the height of the end of the contact tail 101 would be different for adjacent contact elements in view of the difference in the lateral spacing between the center line of nose 103 and tail 101.

In accordance with a preferred embodiment of the present invention, the strap 102 is relatively flexible and is pre-bent in the direction shown in FIGS. 1 and 15 to 18. Thus, as the contact elements are loaded into the base with each bend facing in the same direction, when the bases of the contact tails 101 are pressed down to seat fully in their respective T-shaped slots, the contact connection region 102 deflects more or less to accommodate the lateral separation between the center lines of the nose 103 and the tail 101.

Figure 18:
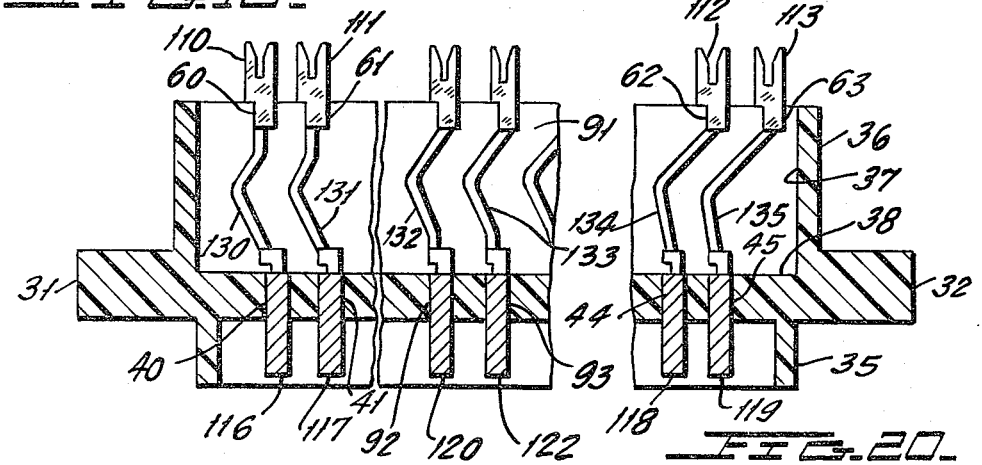
FIG. 18 is a cross-sectional view of the base structure of FIGS. 2 to 5 after the assembly of the contact elements of FIGS. 15 to 17 therein and particularly illustrates the manner in which each of the contact elements flex in the same direction.

FIG. 18 illustrates the assembly of selected contact members (at the center and at the ends a row) in a cross-sectional view of the base. Contact piercing tails 110 to 115 have been located in slots 60 to 63, 90 and 91, respectively, and their corresponding noses pins 116 to 122 have been inserted into openings 40, 41, 44, 45, 92 and 93, respectively. A plurality of ribs 38*a*, 38*b*, 38*c* and others between each pair of slots may be provided on web 38 within well 37 to assist in aligning the various contacts. Each of the flexible connection regions 130 to 135 of the pins in FIG. 18 are pre-bent in the same direction, and during loading will deflect more or less in accordance with the particular lateral displacement between the T-shaped slot and the nose receiving opening for a particular conductor.

Figure 8:
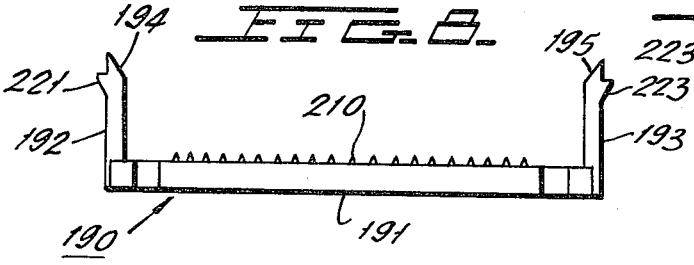
FIG. 8 is an elevation view of the plain cover whch can be snapped onto the base structure.
Figure 11:
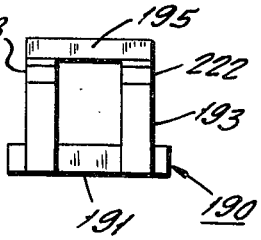
FIG. 11 is an end view of FIG. 8.
Figure 10:
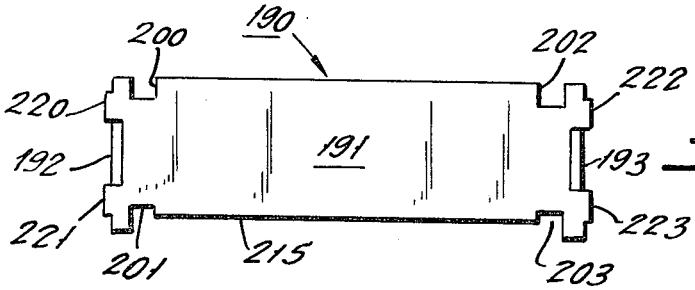
FIG. 10 is a bottom view of FIG. 8.
Figure 13:
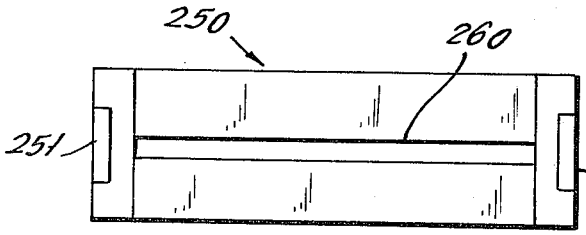
FIG. 13 is a top view of FIG. 12.
Figure 12:
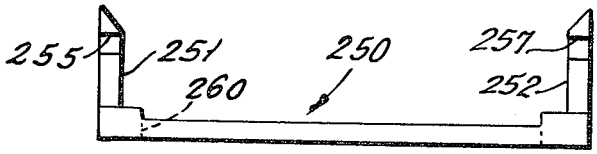
FIG. 12 is an elevation view of the novel stress relief cover of the present invention.
Figure 14:
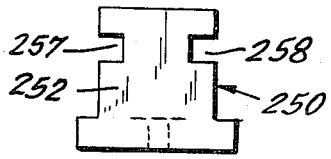
FIG. 14 is an end view of FIG. 12.

After the loading of the contact elements into the base 30, the contact element plug 140 shown in FIGS. 1, 6 and 7 is pressed into the well 37 until the bottom of the plug 140 seats atop the contact nose regions of the contact assemblies to hold the nose regions firmly in place. As best shown in FIG. 8*a*, the upper surface of the plug 140 has an enlarged flange region 141 which is frictionally engaged within the side walls of the well 37 to hold it fixed in place. The top of the plug 140 is generally flush with the top of the base regions 36 after assembly. Plug 140, with barbs 104 and 105 on contact tails 81, locks the contact assemblies in place as shown in FIG. 18*a*. The periphery of plug flange 141 seals across the region of well 37 which contains the opening of each contact tail receiving slot, such as slot 81 in FIG. 18*a*. The bottom of flange 141 seats atop the surface 102*a* of tail 101. The bottom of the plug bears on the flange 102*b* of nose 103 to hold the top of nose 103 firmly against the web 38.

In order to accurately locate a flat cable relative to the base, the base is provided with integral positioning projections 150 and 153. During use, a flat cable is laid across the top of the contact tails above the base 30 in FIG. 1 and extends in a direction perpendicular to well 37. The cable is automatically aligned between posts 150 and 151 on one side and posts 152 and 153 on its other side.

Base 30 is further provided with latching means for receiving plain and strain relief cable covers. The covers are guided into place by pairs of vertical guide end surfaces 170–171 and 172–173 which are integral with base 30. The base 30 also contains vertically spaced camming projections 175–176 and similar camming projections on the other side of the base 30 including the camming projection 177 visible in FIG. 4. The camming projections 175, 176 and 177 (and the further projection not shown and disposed beneath projection 177), serve to latch a plain U-shaped cover 190 which is shown in FIGS. 1 and 8 to 11 in one of two positions on base 30.

The cover 190 has a main surface 191 and two integral end extensions 192 and 193 which are relatively flexible. Each end extension consists of a pair of legs extending from the body of the member 190 which are joined at their outer ends by base members 194 and 195, respectively.

Each of the base members 194 and 195 has an inner chamfer so that they can cam over the projections such as projections 175, 176 and 177 on the base 30 when the cover is pressed onto the base 30. The spaced legs of the end sections 192 and 193 permit the end sections to snap over either pair of projections 176–177 or 176 and another not shown, after the trailing end of bases 194 and 195 have cleared the projections.

The width of extensions 192 and 193 is such as to be snugly guided between the guiding projections 170 and 171 on one end of base 30 and 172 and 173 on the other end of base 30. Thus, these guides provide automatic alignment for the cover 190 relative to the base 30 and assists the cover in resisting side loading and the like.

The manner in which the cam members 176 and 177 or 175 and another (not shown) engage the cover 190 permits the cover to be removed, particularly from a loose-latching position on cam projections 176 and 177, after they have once been engaged without destroying the cover. Moreover, the base can be supplied with the cover either loose or in a position where it is held on the base by the projection members 176 and 177. When the cover is loosely held, the cable can be inserted between the cover and base and the cover can be pressed down to cause the cable to be penetrated by the tines of the various contact tails. The cover 190 ultimately latches under the final cam projections including the projection 175 in the connector base. In this assembly technique, the cover 190 is used as a closed face arrangement.

The cover 190 can also be supplied loose or easily removed from its loose mounting projections 176 and 177. Thus the user can assemble the cable to the base in an open face manner and the cover can be assembled after the cable has been connected to the piercing contacts.

Cover 190 has cutouts 200 to 203 which are aligned with posts 150 to 153, respectively, on the base 30. Thus, when cover 190 is placed atop base 30, it is automatically aligned on the base. As further shown in FIGS. 8 and 9, the underside of cover 190 may have conventional ridges 210 which fit into the seams between the adjacent conductors in the cable which is to be assembled onto the connector to align the conductors with their respective contact tail.

The lateral side 215 of the cover 190 is slightly foreshortened relative to its opposite side. This allows a flat conductor cable to bend around the cover on side 215 so that it will have a better fit within the rectangular profile of the connector.

The plain cover 190 further contains camming projections 220 to 223 at the free ends of the latching arms of the cover 190. These cams receive a strain relief cover 250 which is shown in FIGS. 1 and 12 to 14. The strain relief cover 250, like cover 190 and the other components of the connector, may be of a molded insulation material and has latching projections 251 and 252 which are chamfered at their inner edges as shown and which have notches 255–256 and 257–258. These receive projections 220 to 223, respectively, of the cover 190. The strain relief cover 250 is then provided with a central slot 260 which extends through the cover and can receive the cable which is to be connected to the connector of the invention.

Figure 19:
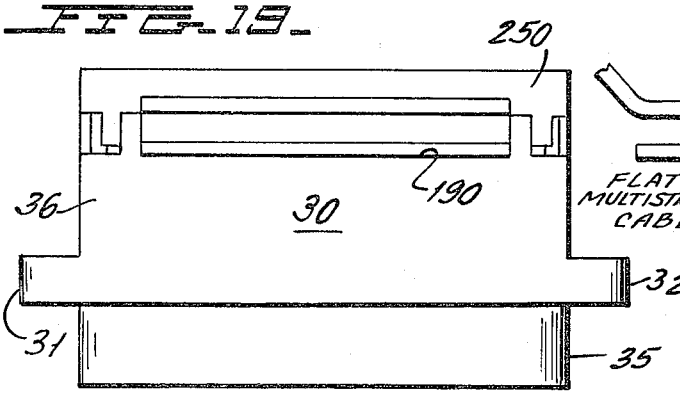
FIG. 19 is an elevation view of the device of the invention after it is assembled and with the covers in place.
Figure 20:
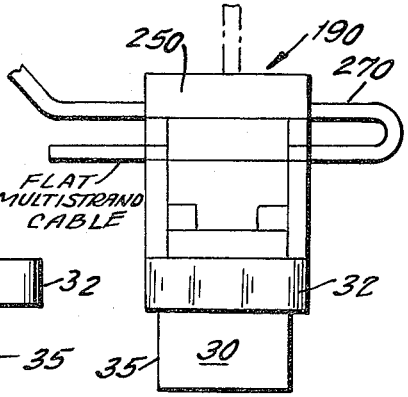
FIG. 20 is an end view of FIG. 19.

The assembled connector of the invention is shown in FIGS. 19 and 20 where it is seen, particularly in FIG. 20, that a flat multi-conductor cable 270 has been laid over the top of the contact tails within the base 30 and that the cover 190 has pressed the cable into engagement with the tails. The flat cable is then bent around the edge 215 of the cover 190 (although it is shown loose for clarity in FIG. 20) and then passes through the space between cover 190 and strain relief cover 250 to exit from the connector. If desired, the multi-conductor cable 270 could have been introduced through the center slot 260 in the strain relief cover 250 and then looped around and under the cover 190. By arranging the cable in this manner, the cable leaves the connector from a central region on the connector.

In the embodiment of FIGS. 1, 15, 16, 17 and 18, the contacts, such as contact 100, all tend to bend or deflect in the same direction when they are assembled on base 30. This is done by pre-bending the flexible contact portion 102. The contacts can be caused to bend in the same direction by other methods than bending before installation. Thus, in FIGS. 21 and 22, the contact 280 has the same general structure as contact 100 of FIGS. 1 and 15 to 18, and similar numerals identify similar parts of the figures. In FIGS. 21 and 22, three equally spaced creases 281, 282 and 283 are stamped into straight flexible section 102. Central crease 282 faces in the desired direction of bending of the section 102 while creases 281 and 283 face away from the desired direction of bending. When a force F is applied to the contact during assembly, the creases 281 to 283 cause section 102 to bend as shown in dotted lines. By lining up all contacts with crease 282 facing in the same direction, all contacts will bend in the same direction. Dimples or other indents can be used in place of the creases 281, 282 and 283.

In FIGS. 23 and 24, elements similar to those of FIGS. 2 to 5 are given the same identifying numerals. However, the openings 300 to 305 and 310 to 315 in the base web 316 have a larger diameter than those of FIGS. 2 to 5 to accept a female nose element which will have a larger outside diameter than the male nose pin used in the contacts of the male connector. Moreover, the base web 316 is thicker than its counterpart base web 38 in FIG. 4.

As was shown in FIG. 1, ribs **38*a*, 38*b* and 38*c* are used to align the various contacts. These ribs are shown in detail in FIGS. 23 and 24 as ribs which are located on opposite sides of each nose-receiving slot. Thus, ribs 320 to 327, for example, cooperate with openings 300, 301, 302, 303, 304 and 305** and define tracks for guiding the contact region above the nose into its respective slot. These ribs then force the flexible contact regions to bend in the proper direction and ensure proper control of the assembly process.

As a further important feature of this invention, and as best shown in FIGS. 21 and 22, the nose end 103 of the contact preferably has a slight bulge 350 which ensures a snug fit of the contact nose when it is inserted into its opening in base web 38. The nose end 103, in fact, is conventionally rolled to cylindrical shape from flat material. Thus, the nose is rolled to a larger diameter at some intermittent region, preferably its upper region, than at its lower region. By way of example, for the male nose illustrated herein, the diameter of openings 40 to 45 and 50 to 55 is 0.042 inch. The bottom of nose 103 is then about 0.040 inch to ensure easy loading of the noses into their openings, but the upper portions of the nose have bulge 350 which has an expanded diameter of about 0.044 inches. This ensures a snug fit within the base web opening receiving the contacts.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A cable connector for flat cable; said cable connector comprising an insulation base of generally rectangular configuration and having contact piercing members extending from one surface thereof and respective contact noses extending from an opposite surface thereof, a plain cover means for covering said contact piercing member and the cable connected thereto; said plain cover means comprising a flat cover section having extending relatively flexible end sections; each of said end sections having repective first latch means; the opposing side surfaces of said base each having first and second vertically spaced cooperating cam projection means each operable to receive said first latch means and to fix said plain cover means over said base at a first and second respective height above the top surface of said base; said first latch means and first cam projection being easily disconnected whereby said plain cover means can be loosely connected to said base by latching of said first latch means and said first cam projection means, and is more closely secured to said cover means where said first latch means engages said second cam projection means;

a strain relief cover, said strain relief cover having a flat section and two end sections defining a U shape, said two end sections having second latch means thereon; said plain cover means having third cam projection means extending from the outer surfaces of its said flexible end sections; said second latch means being engageable with said third cam projection means to hold said strain relief cover onto said plain cover means.

2. The cable connector of claim 1 wherein said plain cover means has a side edge which is recessed relative to the top surface of said base to form a region to receive the thickness of a flat cable which is wrapped over said side edge so that said cable does not extend beyond a generally rectangular configuration of said connector.

3. A cable connector for flat cable, comprising:

a molded insulation material base having a rectangular well formed therein and at least one upstanding wall;

a plurality of equispaced openings formed in and extending through the bottom of said rectangular well, each of said openings being formed along a straight line;

a plurality of equispaced contact receiving slots, equal in number to the number of said equispaced openings, formed in said upstanding wall, each of said slots being formed along a line parallel to said straight line and associated with a respective one of said openings;

a plurality of identical contacts, equal in number to the number of said equispaced openings, each of said contacts having a contact nose end, a contact piercing tail end and a connector section connecting said nose end to said tail end, each of said connector sections being prebent at a location generally midway between their ends, each of said connector sections being easily bendable at its respective said prebent location in a direction parallel to said straight line, said nose end of each of said contacts being fitted through a respective one of said openings, said tail end of each of said contacts being received in that one of said slots which is associated with that one of said openings through which its tail end is fitted whereby at least one of said connector sections is bent at its prebent location by a different amount than at least one other said connector section;

the ends of each of said contact nose ends defining a first straight line; the ends of said contact piercing tail ends defining a second straight line which is parallel to said first straight line.

4. The cable connector of claim 3 wherein each of said connector sections of each of said contacts is bent in the same direction.

5. The cable connector of claim 3 wherein said slots are spaced from one another by a multiple of 0.054 inch and said openings are spaced from one another by a multiple of 0.050 inch.

6. The cable connector of claim 3 which further includes a second upstanding wall parallel to and opposing said one upstanding wall and extending from said base web; a second plurality of openings in said web which are aligned parallel to said first-mentioned plurality of openings, and which are staggered relative to said first-mentioned plurality of openings; and a second plurality of equally spaced slots in the upper end of said second upstanding wall which opposes said one of said upstanding walls; and a second plurality of contacts received in said well and disposed between respective openings and slots of said second plurality of slots in the manner identical to that of said first mentioned plurality of contacts, openings and slots.

7. The cable connector of claim 6 wherein each connector section of each of said pluralities of contacts are bent in the same direction.

8. The cable connector of claim 3 or 6 which further includes plain cover means comprising a flat cover section having extending relatively flexible end sections; each of said end sections having respective first latch means; the opposing side surfaces of said base each having first and second vertically spaced cam projection means each operable to receive said first latch means and to fix said plain cover means over said base at a first and second respective height above the top surface of said base; said plain cover means being loosely connected to said base by latching of said first latch means and said first cam projection, and is more closely secured to said cover means when said first latch means engages said second cam projection means.

9. The cable connector of claim 8 which further includes a strain relief cover; said strain relief cover having a flat section and two end sections defining a U shape; said two end sections having second latch means thereon; said plain cover means having third cam projection means extending from the outer surfaces of its said flexible end sections; said second latch means being engageable with said third cam projection means to hold said strain relief cover onto said plain cover means.

10. The cable connector of claim 8 wherein said plain cover means has a side edge which is recessed relative to the top surface of said base to form a region to receive the thickness of a flat cable which is wrapped over said side edge so that said cable does not extend beyond a generally rectangular configuration of said connector.

11. The cable connector of claim 6 wherein said openings of said pluralities of openings and said slots of said pluralities of slots are, respectively, laterally displaced from one another by a different distance for adjacent contacts in each of said rows.

12. The cable connector of claim 11 wherein each connector section of each of said pluralities of contacts are bent in the same direction.

13. The cable connector of claim 12 wherein the openings of each of said rows are spaced by 0.10 inch and the slots of each of said walls are spaced by 0.108 inch.

14. The cable connector of claim 3, 7, 12 or 13 which further includes plug means fixed in said rectangular well and having a plug bottom pressing on the top of said contact noses to fix said contact noses in said base; said connector sections being disposed along the side of said plug means; the top of said plug means being flush with the top of said rectangular well; said plug means having a flange which fixes said tail end of said contacts in their said respective slots.

15. The cable connector of claim 14 which further includes plain cover means comprising a flat cover section having extending relatively flexible end sections; each of said end sections having respective first latch means; the opposing side surfaces of said base each having first and second vertically spaced cam projection means each operable to receive said first latch means and to fix said plain cover means over said base at a first and second respective height above the top surface of said base; said plain cover means being loosely connected to said base by latching of said first latch means and said first cam projection, and is more closely secured to said cover where said first latch means engages said second cam projection means.

16. The cable connector of claim 14 which further includes a strain relief cover; said strain relief cover having a flat section and two end sections defining a U shape; said two end sections having second latch means thereon; said plain cover means having third cam projection means extending from the outer surfaces of its said flexible end sections; said second latch means being engageable with said third cam projection means to hold said strain relief cover onto said plain cover means.

17. A cable connector for flat cable comprising: an insulation support member; a plurality of identical contacts supported by said support base member and generally equally spaced from one another along a first line; each of said contacts having a contact nose end, a contact piercing tail end and a connector section connecting said nose end to said tail end; each of said connector sections being prebent out of a straight line at a location generally midway between their ends, each of said connector sections being easily bendable at its respective said prebent location in a direction parallel to said first line; said nose end of each of said contacts being fixed to said insulation support member; said tail end of each of said contacts fixed to said insulation support member; said connector sections of each of said contacts being free to flex by different amounts at their said prebent locations; the ends of each of said nose ends lying on a first straight line and the ends of said tail ends lying on a second straight line regardless of differences in spacing of the nose ends and tail ends of said contacts.

18. The cable connector of claim 17 wherein each of said connector sections of each of said contacts is bent in the same direction.

* * * * *